US009714811B2

(12) United States Patent
Pulit, Jr.

(10) Patent No.: US 9,714,811 B2
(45) Date of Patent: Jul. 25, 2017

(54) ADJUSTABLE REAR SIGHT FOR A FIREARM

(71) Applicant: Charles Regis Pulit, Jr., Parkersburg, WV (US)

(72) Inventor: Charles Regis Pulit, Jr., Parkersburg, WV (US)

(73) Assignee: Novak Designs, Inc., Parkersburg, WV (US)

( * ) Notice: Subject to any disclaimer, the term of this patent is extended or adjusted under 35 U.S.C. 154(b) by 0 days.

(21) Appl. No.: 15/009,078

(22) Filed: Jan. 28, 2016

(65) Prior Publication Data

US 2016/0223292 A1 Aug. 4, 2016

Related U.S. Application Data

(60) Provisional application No. 62/109,926, filed on Jan. 30, 2015.

(51) Int. Cl.

| | |
|---|---|
| ***F41G 1/26*** | (2006.01) |
| ***F41G 1/10*** | (2006.01) |
| *F41G 1/18* | (2006.01) |
| *F41G 1/34* | (2006.01) |

(52) U.S. Cl.

CPC ..... *F41G 1/26* (2013.01); *F41G 1/10* (2013.01); *F41G 1/18* (2013.01); *F41G 1/345* (2013.01)

(58) Field of Classification Search

CPC ..... F41G 1/06–1/28

See application file for complete search history.

(56) References Cited

U.S. PATENT DOCUMENTS

| | | | | |
|---|---|---|---|---|
| 3,513,549 A * | 5/1970 | Smiley | F41G 11/003 | 42/126 |
| 3,834,035 A * | 9/1974 | Merrill | F41G 1/08 | 42/133 |
| D315,776 S * | 3/1991 | Novak | D22/109 | |
| 5,467,552 A * | 11/1995 | Cupp | F41G 1/26 | 42/125 |
| 7,032,341 B1 * | 4/2006 | Sconce | F41G 1/26 | 42/111 |
| 7,296,376 B2 * | 11/2007 | Kidd | F41G 1/28 | 42/111 |
| 7,526,890 B1 * | 5/2009 | Keng | F41G 1/18 | 42/111 |

(Continued)

*Primary Examiner* — Stephen M Johnson
*Assistant Examiner* — Joshua Semick
(74) *Attorney, Agent, or Firm* — Tarolli, Sundheim, Covell & Tummino LLP

(57) ABSTRACT

A rear gun sight mountable to a firearm that includes an aperture module defining a gun sight aperture and a base. The base defines a recess for receiving the aperture module and the aperture module includes ribs that are slidably received by associated recess in the base to constrict the aperture module to relative rectilinear movement with respect to the base. At least one spring acts between the base and the aperture module. An adjustment member couples the module to the base such that rotation of the adjustment member moves the module towards and away from the base depending on direction of rotation. A detent resists uncontrolled rotation of the adjustment member. The aperture module includes a recess for receiving a light emitting member such as a tritium module.

13 Claims, 3 Drawing Sheets

(56) References Cited

U.S. PATENT DOCUMENTS

| | | | | |
|---|---|---|---|---|
| 7,610,712 | B2 * | 11/2009 | Ertl | F41G 1/10 42/137 |
| 7,743,546 | B2 * | 6/2010 | Keng | F41G 11/003 42/113 |
| 8,151,510 | B2 * | 4/2012 | Capson | F41G 1/01 42/111 |
| 9,267,759 | B2 * | 2/2016 | Speroni | F41C 27/00 |
| 9,423,212 | B2 * | 8/2016 | Campean | F41G 1/30 |
| 2008/0092424 | A1 * | 4/2008 | Keng | F41G 1/28 42/137 |

* cited by examiner

ADJUSTABLE REAR SIGHT FOR A FIREARM

RELATED APPLICATIONS

This application claims priority from U.S. Provisional Application Ser. No. 62/109,926, filed Jan. 30, 2015, the subject matter of which is incorporated herein in its entirety.

TECHNICAL FIELD

The present invention relates generally to a sight for a firearm and, in particular, to an adjustable rear sight for a pistol, hand gun, rifle or the like.

BACKGROUND ART

A typical firearm sighting system normally consists of a front sight and a rear sight. The front sight is typically a blade or pin that is often in the shape of a small diameter cylinder which is sometimes tapered. The rear sight is typically in the shape of a block with a V-shaped, U-shaped or square-shaped groove or aperture. The gun user uses these sights by centering the top of the front sight with the groove in the rear sight. For some applications, such as target shooting, it is desirable that the firearm sight be adjustable to compensate for elevation, windage, the size and type of projectile or bullet, as well as the charge used to propel the bullet.

SUMMARY OF INVENTION

The present invention provides a new and improved gun sight for use with a firearm, such as a pistol, handgun, rifle or the like.

The invention comprises a rear gun sight that is attachable to a firearm. The gun sight includes a base that is attached to a machined surface on the firearm and an aperture module that is received by the base that can be raised and lowered in order to adjust or compensate for elevation, projectile charge, projectile weight, etc.

The aperture module defines sighting groove or aperture through which a front sight is viewed in order to aim the firearm at a target. The aperture module is received within a recess defined by the base and includes structure which slidably confronts associated structure and surfaces formed by the recess in the base so that the aperture module is rectilinearly movable with respect to the base. The aperture module is restricted to a single direction of motion, i.e., vertical with respect to the base when the gun is held upright. The aperture module is held to the base by an adjustment screw and is biased away from the base by at least one, but preferably two springs. A detent associated with the adjustment screw inhibits uncontrolled rotation of the screw after an elevation adjustment is made to the gun sight.

In an alternate embodiment, the aperture module includes a recess for receiving a tritium module which emits light through a port formed in the module in order to illuminate the gun sight aperture or groove. With the disclosed construction, the position of the aperture module with respect to the base is unaffected by recoil or other forces. The structures for confining the movement of the aperture module inhibit twisting or tilting of the module with respect to the base which, if permitted, would result in targeting errors.

Additional features of the invention will become apparent and a fuller understanding obtained by reading the following detailed description made in connection with the accompanying drawings.

BEST MODE FOR CARRYING OUT THE INVENTION

Figure 1:
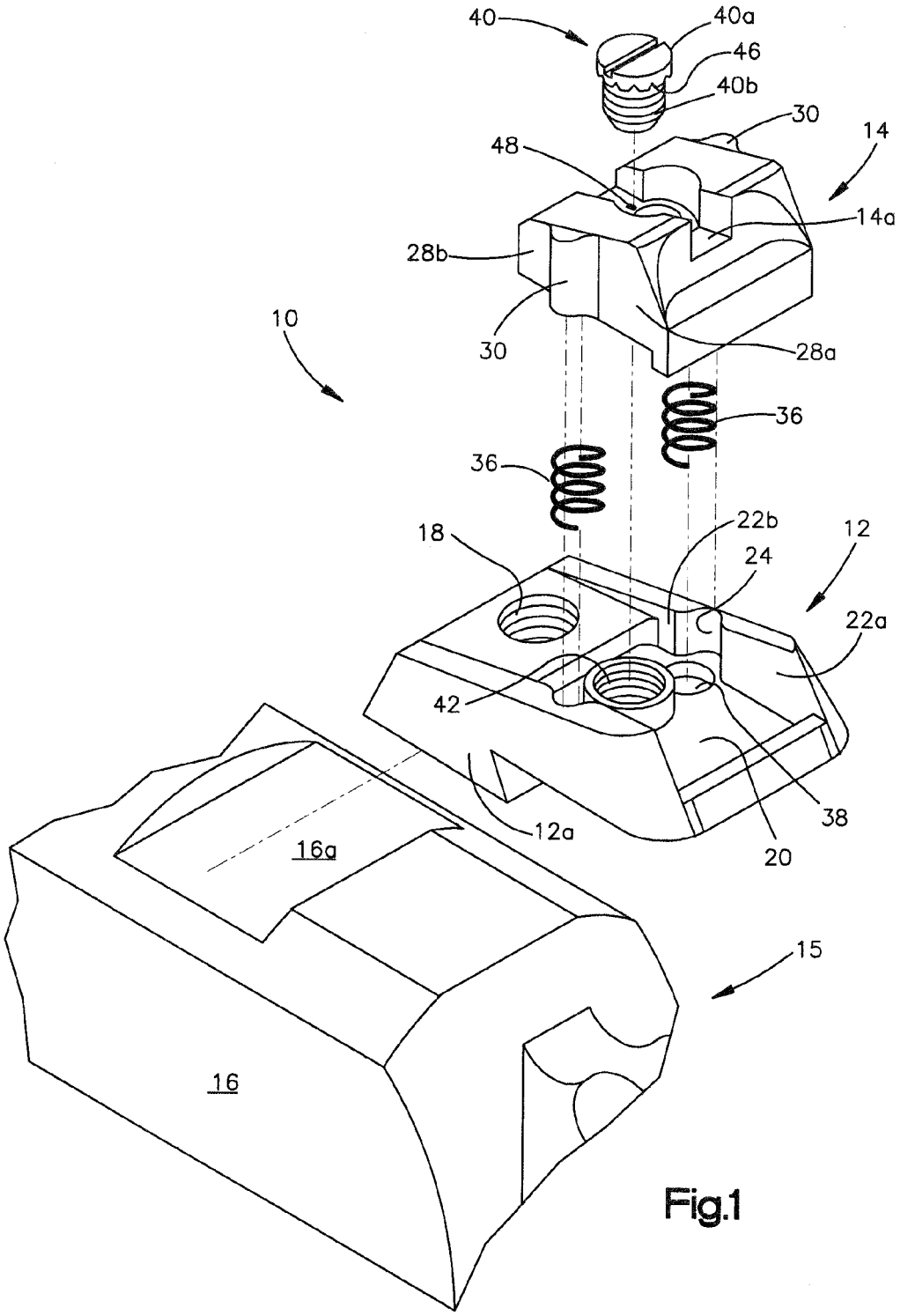
FIG. 1 is an exploded, partially fragmentary view of a gun sight constructed in accordance with a preferred embodiment of the invention showing how it is mounted to a weapon.

FIG. 1 illustrates the overall construction of rear gun sight 10, constructed in accordance with a preferred embodiment of the invention. As seen in FIG. 1, the gun sight 10 includes a base 12 and a vertically adjustable aperture module 14. The base 12 is slidably received by a firearm, indicated generally by the reference character 15 in FIG. 1. For purposes of explanation, the disclosed gun sight 10 will be shown and described as it would be used with a pistol of the type shown in FIG. 1 which includes a slide 16.

As seen in FIG. 1, the pistol 15 includes a machined groove or slot 16*a*, which, in the illustrated embodiment, is substantially a dovetail in cross-section. The dovetail groove 16*a* receives a complementally-shaped slide portion 12*a* integrally formed with the base 12. The base 12 is mounted to the pistol by sliding it transversely in the machined groove 16*a* and, once in position, a locking screw (not shown) which is threadably received by a threaded bore 18 formed in the base 12 locks the base to the pistol. As is known, the locking screw is rotated until a distal end of the screw (not shown) abutably contacts the top surface of the pistol groove 16*a* and, thus locks the base 12 to the pistol 15. The gun sight mounting illustrated in FIG. 1 is but one example of a method for mounting a gun sight to a fire arm. There are other various types of mounting arrangements for gun sights that are known in the prior art and are contemplated by the present invention.

The aperture module 14 is generally square in shape and is slidably received within a recess 20 defined by the base 12. The aperture module 14 defines a sighting aperture or notch 14*a* through which a front sight (not shown) is viewed and aligned. The recess 20 of the base 12 includes vertical sidewalls 22*a*, 22*b* which are located on either side of an associated vertical notch or recess 24 (as viewed in FIG. 1) which, as will be described, control the positioning and movement of the aperture module 14.

Figure 2:
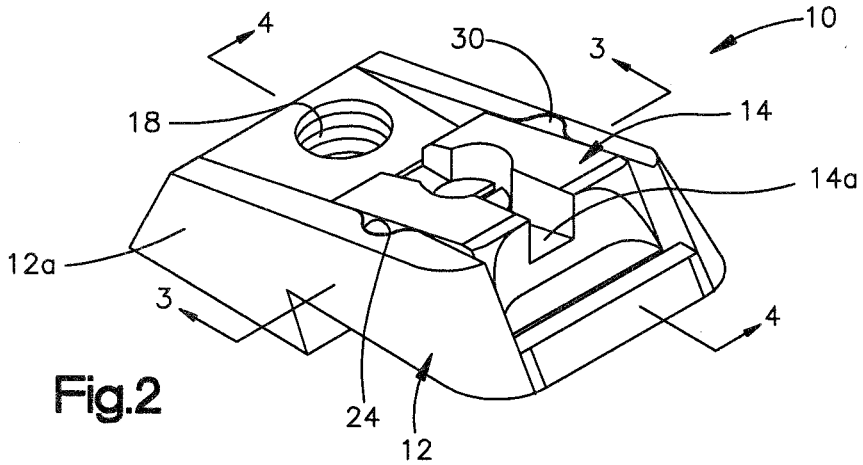
FIG. 2 is a perspective, assembled view of the gun sight shown in FIG. 1.
Figure 3:
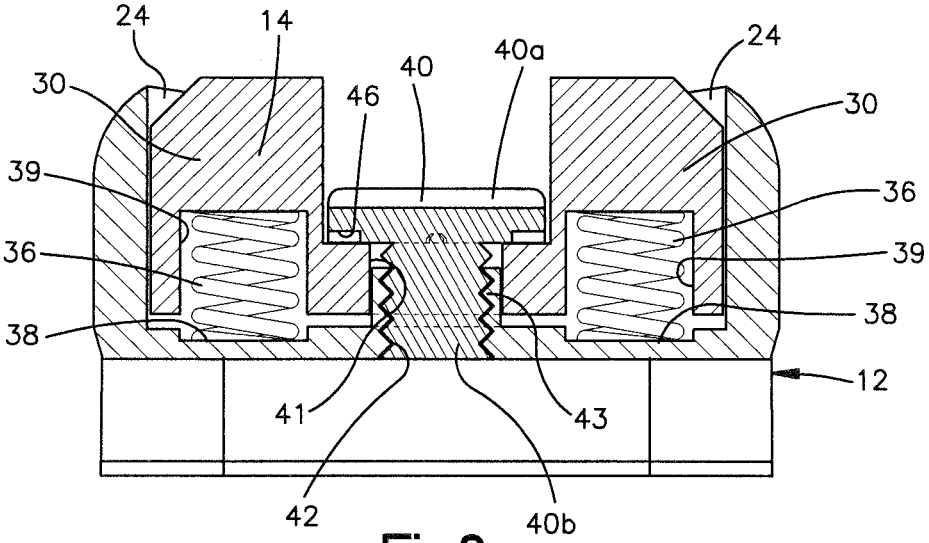
FIG. 3 is a sectional view of the gun sight shown in FIG. 2 as seen from the plane indicated by the line 3-3 in FIG. 2.
Figure 4:
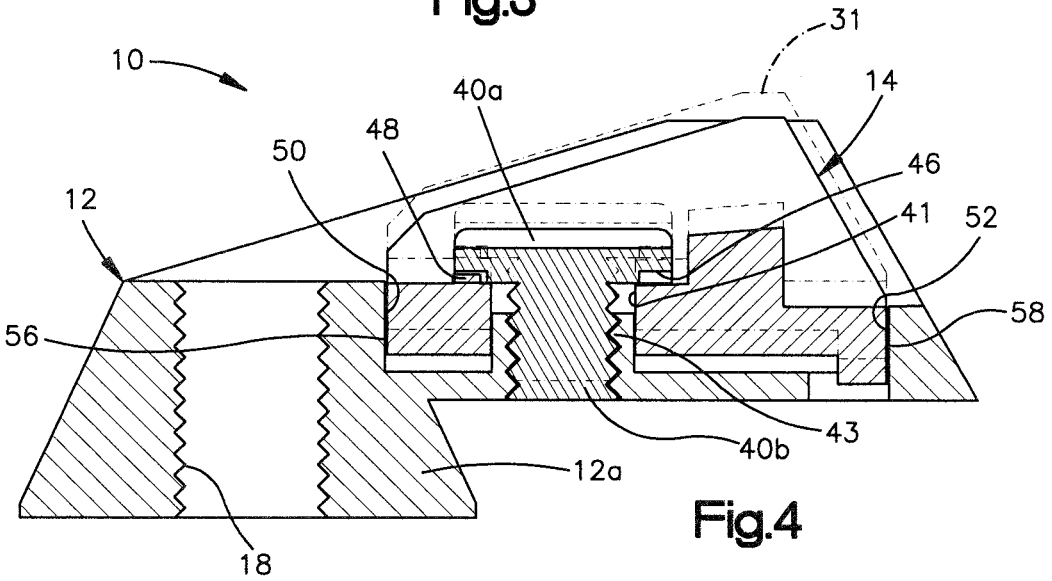
FIG. 4 is another sectional view of the gun sight shown in FIG. 2 as seen from the plane indicated by the line 4-4 in FIG. 2.
Figure 7:
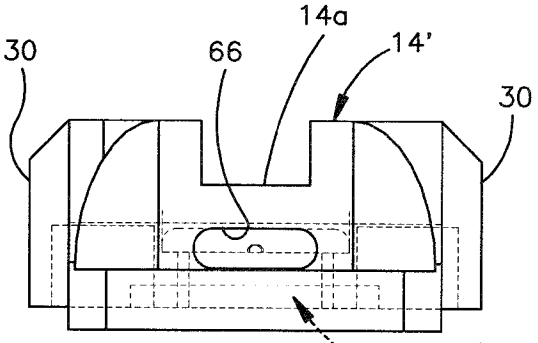
FIG. 7 is a rear elevational view of the aperture module shown in FIG. 6 and, FIG. 8 is a sectional view of a gun sight that includes the alternate aperture module shown in FIG. 5.
Figure 6:
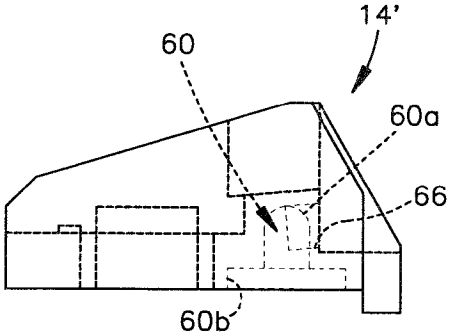
FIG. 6 is a side elevational view of the alternate aperture module that forms part of the gun sight shown in FIG. 8.

The aperture module 14, which may be formed from steel billet and suitably hardened, is configured to be slidably received by the recess 20 formed in the base 12 but is restricted to vertical, up and down, movement within the recess 20, as viewed in FIG. 1. In particular, the aperture module 14 includes its own side surfaces 28*a*, 28*b* located on either side of a vertical lug or rib. When the aperture module 14 is mounted in position within the base 12 (as seen in FIGS. 2 and 3), the surfaces 28*a*, 28*b* of the module 14 confront the associated surfaces 22*a*, 22*b* formed in the base 12. Clearance between the confronting surfaces however, is provided so that the module 14 may freely move vertically with respect to the base 12, as viewed in FIG. 1 and as indicated in FIG. 4 by the phantom line 31, The vertical ribs or lugs 30 is slidably received by the associated recesses 24 formed in the base 12. The engagement of the lugs 30 with the associated recesses or slots 24 restrict relative movement between the aperture module 14 and the base 12 to one direction, i.e., vertical as viewed in FIG. 1. Relative tilting between the aperture module 14 and the base 12 is substantially inhibited. The module 14 is limited to rectilinear movement with respect to the base 12.

The aperture module 14 is biased upwardly (or away from the base 12) by a pair of coil springs 36, the lower ends of which are received in associated pockets 38 formed in the base and the upper portions of which are received in associated bores 39 formed in the aperture module 14, which are shown best in FIG. 3.

The aperture module 14 is adjustably held to the base by a threaded fastener 40 which includes a head 40*a* and a depending threaded stem 40*b*. The threaded stem of the fastener extends through an aperture module screw hole or bore 41 and is received by a threaded bore 42 formed in the base 12. In the illustrated embodiment, the threaded bore 42 is formed in a column structure 43 that is slidably received by the aperture module bore 41. In the illustrated embodiment, and as viewed in FIG. 1, clockwise rotation of the threaded fastener 40 causes the aperture module 14 to move towards the base 12, whereas counterclockwise rotation of the fastener allows the coil springs 36 to move the aperture module 14 away from the base 12. As should be apparent, the threaded fastener 40 is used to adjust the elevation of the rear gun sight 10.

A detent mechanism is provided to inhibit uncontrolled rotation of the adjustment fastener due to recoil forces, etc. Referring in particular to FIGS. 1, 3 and 4, the underside of the adjustment screw head 40*a* includes a plurality of teeth 46. As seen best in FIGS. 1 and 4, the aperture module 14 includes a raised lug 48, which may be integrally formed with the module 14. The lug 48 is engageable by the teeth 46, such that after the adjustment screw 40 is rotated to a desired position, the lug 48 engages the spacing between the teeth 46, thus inhibiting rotation of the adjustment screw 40.

As should be apparent, the aperture module 14 is securely held to the base 12 and is substantially unaffected by recoil forces that are generated when the gun is fired. As indicated above, the vertical ribs 30 substantially resist tilting or uncontrolled movement of the aperture module 14 with respect to the base 12. To further resist relative movement (except in the vertical direction) between the aperture module 14 and the base 12, front and rear recoil surfaces are on formed on both the base 12 and the module 14. As seen best in FIG. 4, the base includes a front vertical recoil surface 50 and a rear recoil surface 52. The aperture module 14 includes associated vertical surfaces 56 and 58 which slidably confront the associated recoil surfaces 50, 52 formed on the base 12. These recoil surfaces in combination with the vertical ribs 30 and associated receiving surfaces 24 confine movement of the module 14 relative to the base 12 to a single direction, i.e., the vertical direction, as viewed in FIG. 4. The rear portion of the module 14 which defines the rear recoil surface 58 also defines a gap shield 59. As seen in FIG. 4, the movement of the module 14 relative to the base 12 in the vertical direction between upper and lower positions, is indicated by the phantom line 31.

It should be apparent that, in the preferred embodiment, the aperture module 14 is "free floating" in a single direction and is rectilinearly movable with respect to the base 12.

Figure 5:
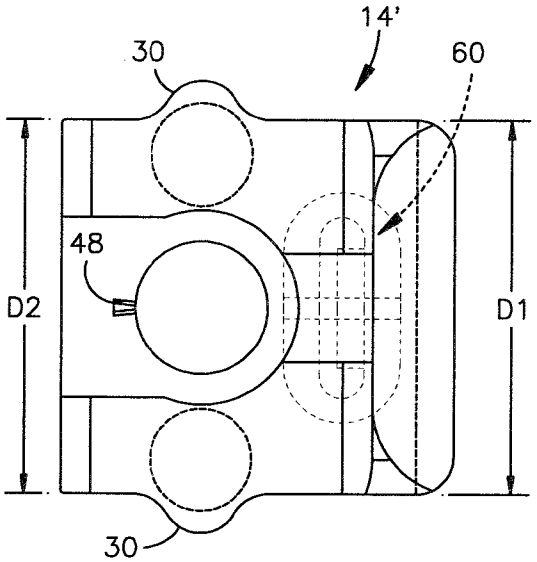
FIG. 5 is a top plan view of an aperture module constructed in accordance with another embodiment of the invention.
Figure 8:
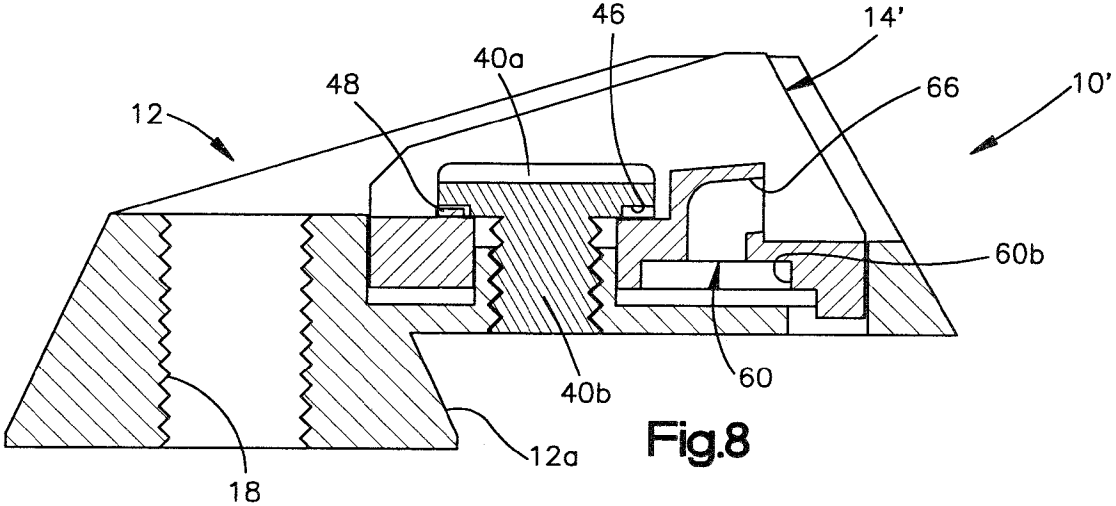

In the preferred embodiment, the aperture module 14 is tapered slightly front to back. As seen in FIG. 5, a transverse dimension D2 at the front of the aperture module is slightly smaller than the dimension D1 at the rear of the aperture module. By tapering the aperture module, light is blocked from passing between the confronting surfaces of the aperture module and the base 12 which could interfere with sighting of the target through the module aperture 14*a*. For the aperture modules shown in FIG. 1 and FIG. 5, the taper is approximately 0.002 inches FIGS. 5-8 illustrate an alternate embodiment 10' of the adjustable rear gun sight. The structures that control movement of the aperture module with respect to the base 12 are the same as those disclosed and shown in FIGS. 1-4 and will be given the same reference characters. However, the alternate embodiment 10' includes a modified aperture module 14' which has an illumination feature for facilitating use of the gun sight in dark conditions. As seen best in FIGS. 6-7, the alternate aperture module 14' includes a hat-shaped recess 60 (as viewed in FIG. 6), which is adapted to receive a tritium module or insert. As is known, a tritium module generally includes a tube containing a radioactive gas which emits light.

In the preferred embodiment, the hat-shaped recess 60 includes a narrow vertical section 60*a* which extends transversely in a rear section of the module 14'. This recess portion 60*a* is adapted to receive the tritium tube (not shown) and may be held therein by various methods such as adhesive or epoxy which may be applied to the tube and the elongate base recess portion 60*b* (which forms the brim of the "hat") to secure the tritium tube in the recess 60. Referring also to FIG. 5, an oval port 66 extends from the rear of the aperture module 14' and opens into the recess portion 60*a* in which the tritium tube is held. The light emitted by the tritium tube is emitted through this port and thus illuminates the sighting aperture 14*a* (shown best in FIG. 7). As is known the illuminated rear sight, shown in FIGS. 5-8 would be used in conjunction with an illuminated front sight, thus allowing the gun user to sight a target at night.

It should be noted here, that the present invention can be implemented with alternate constructions for the disclosed gun sight. For example, the ribs or lugs formed on the aperture module 14 and the associated recesses 24 formed in the base 12 can be reversed so that the base 12 includes lugs and the aperture module includes associated recesses. In addition, multiple lugs/recesses on each side of the aperture module 14 and base 12 are also contemplated.

It should be apparent that the disclosed gun sight has several design features which enhance its performance and ease of use. The aperture module 14 is free floating but is constricted to rectilinear motion with respect to the base 12 by the rib/recess 30, 24 engagement. This design feature allows the sight to compress into itself, providing for a more compact design and significant reduction in height and weight as compared to more conventional adjustable gun sights. As a result, the disclosed gun sight has a lighter weight than many prior art gun sights. The reduced mass of the aperture module 14 provides less force transmission when the gun is fired due to its lighter weight.

Another benefit of the parallel floating design is that the pressure from the springs 36 hold the aperture module 14 evenly against the elevation adjusting screw head 40 reducing fatigue, as compared to many conventional designs. The disclosed free floating aperture module 14 eliminates the need for a cross pin that is present in many prior art designs and, thus, machining time for the disclosed gun sight is reduced and fewer parts need to be assembled.

In the preferred embodiment, the elevation adjustment screw hole or bore 41 preferably has a diameter that provides sufficient clearance for the adjustment screw threaded stem 40*b* so that the stem 40*b* does not come into contact with the screw bore 41, thus reducing or eliminating the chance for possible impacting damage/fatigue to the adjustment screw 40.

The column structure 43 formed in the base 12 which is slidably received in the aperture module bore 41 allows for greater travel of the adjustment screw 40. In addition, the slidable engagement between the aperture module bore 41 and the column structure 43 provides another recoil absorption area to reduce possible damage from repeated recoil forces.

As discussed above, in an alternate construction, the aperture module 14' mounts a tritium module or insert for providing illumination in dark conditions. The tritium module is located in a hat-shaped recess 60. According to this preferred embodiment, a method for machining a cavity for the tritium module is as follows. First, a large slot at the top of the underside of the aperture module 14 is machined. A ball end mill is then used to machine a smaller cut deeper beyond that which exposes the inside area to the oval window or port 66 machined under the sight notch 14*a*. This is done in such a manner that when the cylindrical tritium module is placed in position from the underside of the aperture, it will self align with the window 66. Once in place, this design allows the epoxy resin to flow evenly around the tritium vial or module and thus sealing it into a permanent position to be seen through the window or port 66.

The disclosed gun sight reduces the machining process to a minimal number of steps compared to prior art adjustable gun sights. In addition, the disclosed gun sight has a reduced number of components, as compared to prior art gun sights. A relatively simple assembly process is needed to assemble the disclosed gun sight as compared to more conventional adjustable gun sights. The only tool required is a small screwdriver.

Although the invention has been described with a certain degree of particularity, it should be understood that those skilled in the art can make various changes to it without departing from the spirit or scope of the invention as hereinafter claimed.

The invention claimed is:

1. A rear gun sight for a fire arm comprising:

a) a base including structure for removably mounting said base to a fire arm;

b) an aperture module defining a gun sight aperture;

c) said base defining a recess for receiving said aperture module, said aperture module and base defining locating surfaces that confront each other when said aperture module is received by said recess;

d) one rib formed on one of said base and aperture module and an associated recess for slidably receiving said one rib, said associated recess formed on the other of said base and aperture module, and another rib formed on one of said base and aperture module and another associated recess formed on the other of said base and aperture module for slidably receiving said another rib, said one and another rib and associated recesses for constrict movement of said aperture module to rectilinear movement with respect to said base;

e) at least one spring acting between said base and said aperture module for urging said aperture module away from said base;

f) an adjustment member for adjustably coupling said aperture module to said base, such that rotation of said adjustment member rectilinearly moves said aperture module towards and away from said base depending on the direction of rotation; and g) a detent for resisting uncontrolled rotation of said adjustment member;

h) said adjustment member comprising a threaded fastener having a head and a depending threaded segment, said threaded segment extending through an opening in said aperture module and threadedly engaging a threaded bore formed in the base;

i) said threaded bore for receiving said threaded segment being formed in a column structure forming part of said base, said column structure slidably received in said aperture opening through which said fastener segment extends, said engagement of said ribs with said associated recesses and said engagement of said column structure with said aperture opening operate to substantially reduce the transmission of recoil forces to said adjustment member.

2. The gun sight of claim 1 wherein said aperture module includes a pair of ribs on opposite of sides of said aperture module and said base includes associated recesses for slidably receiving said ribs.

3. The apparatus of claim 1 wherein said aperture module has a front transverse dimension that is smaller than a rear transverse dimension, such that said aperture module is generally tapered front to back.

4. The gun sight of claim 1 wherein said aperture module includes a recess for receiving a light emitting member that emits light through a transverse port formed at the rear of said aperture module and below said gun sight aperture.

5. The gun sight of claim 1 wherein said detent for resisting uncontrolled rotation of said adjustment member comprises a raised lug formed on said aperture module that is engageable by teeth formed on the underside of said fastener head.

6. The gun sight of claim 1 further including two springs acting between said base and said aperture module, the lower ends of said springs being received in associated pockets formed in the base and the upper portions of which are received in associated bores formed in the aperture module.

7. The gun sight of claim 4 wherein said recess is hat-shaped and includes a portion which is adapted for receiving said light emitting member and communicates with an oval port through which light from said light emitting member can exit said aperture module.

8. The gun sight of claim 7 wherein said light emitting member is a tritium module.

9. A rear gun sight for a fire arm comprising:

a) a base;

b) an aperture module defining a gun sight aperture;

c) said base defining a recess for receiving said aperture module, said aperture module and base defining locating surfaces that confront each other when said aperture module is received by said recess;

d) at least one rib formed on one of said base and aperture module and an associated recess formed on the other of said base and aperture module, said associated recess for slidably engaging said rib and said slidable engagement of said rib and associated recess allowing rectilinear movement of said aperture module with respect to said base;

e) at least one spring acting between said base and said aperture module for urging said aperture module away from said base;

f) a threaded adjustment member for adjustably coupling said aperture module to said base, such that rotation of said adjustment member rectilinearly moves said aperture module towards and away from said base depending on the direction of rotation; and g) said threaded adjustment member including a head engageable with engagement structure on said aperture module and a threaded segment which extends through an opening in said aperture module and engages a threaded bore in a column structure formed in said base, said column structure slidably received by said aperture module opening, said engagement of said ribs with said associated recess and said engagement of said column structure with said aperture module opening operate to constrict movement of said aperture module to rectilinear movement with respect to said base and to substantially reduce the transmission of recoil forces to said adjustment member.

10. The gun sight of claim 9 wherein said structure on said aperture module includes a lug that is engageable by teeth formed on the underside of said adjustment member head.

11. The gun sight of claim 9 wherein said aperture module includes a pair of ribs formed on opposite sides of said aperture module that are slidably engageable with associated recesses formed on said base.

12. The gun sight of claim 9 wherein said at least one rib is formed on said aperture module and said associated recess is formed on said base.

13. The gun sight of claim 9 wherein said one rib is formed on said aperture module and said associated recess is formed on said base.

* * * * *